US010205248B1

(12) United States Patent
Zheng et al.

(10) Patent No.: US 10,205,248 B1
(45) Date of Patent: Feb. 12, 2019

(54) ANTENNA STRUCTURE FOR CONCURRENT CHANNEL COMMUNICATION

(71) Applicant: Amazon Technologies, Inc., Seattle, WA (US)

(72) Inventors: Ming Zheng, Santa Clara, CA (US); Adrian Napoles, Gilroy, CA (US); Jay Praful Desai, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 15/684,644

(22) Filed: Aug. 23, 2017

(51) Int. Cl.

| | |
|---|---|
| ***H01Q 21/00*** | (2006.01) |
| ***H01Q 1/12*** | (2006.01) |
| ***H01Q 9/16*** | (2006.01) |
| ***H01Q 13/10*** | (2006.01) |
| ***H01Q 3/30*** | (2006.01) |
| ***H01Q 1/48*** | (2006.01) |

(52) U.S. Cl.
CPC ..... *H01Q 21/0006* (2013.01); *H01Q 1/12* (2013.01); *H01Q 1/48* (2013.01); *H01Q 3/30* (2013.01); *H01Q 9/16* (2013.01); *H01Q 13/10* (2013.01)

(58) Field of Classification Search
CPC ..... H01Q 21/0006; H01Q 1/48; H01Q 3/30; H01Q 9/16; H01Q 1/12
USPC ..... 343/727
See application file for complete search history.

(56) References Cited

U.S. PATENT DOCUMENTS

| | | | | |
|---|---|---|---|---|
| 9,973,250 | B2 * | 5/2018 | Noh | H04L 5/0023 |
| 9,985,334 | B2 * | 5/2018 | Beaton | G02C 7/04 |
| 9,986,542 | B2 * | 5/2018 | Ko | H04L 1/1607 |
| 10,084,489 | B2 * | 9/2018 | Mura | H04B 1/006 |

OTHER PUBLICATIONS

Biedka, M. et al. "Ultra-Wide Band Non-Reciprocity through Sequentially-Switeched Delay Lines" Scientific Reports, www.nature.com/scientificreports, 16 pages, Published Jan. 6, 2017.
DUPLO Project, http://www.fp7-duplo.eu/, 3 pages, retrieved Aug. 23, 2017.
Kumu Networks, http://kumunetworks.com/, 2 pages, retrieved on Aug. 23, 2017.

* cited by examiner

*Primary Examiner* — Brian Young
(74) *Attorney, Agent, or Firm* — Lowenstein Sandler LLP

(57) ABSTRACT

Antenna structures and methods of operating the same are described. An antenna structure may include an antenna carrier, a first antenna disposed on the first antenna carrier and coupled to a first radio frequency (RF) feed, a second antenna disposed on the first antenna carrier and coupled to a second RF feed, a third antenna disposed on the first antenna carrier and coupled to a third RF feed, and a fourth antenna disposed on the first antenna carrier and coupled to a fourth RF feed. The first antenna and the second antenna may be located along a first axis of the antenna carrier that passes through a center of the antenna carrier. The third antenna and the fourth antenna may be located along a second axis of the antenna carrier that passes through a center of the antenna carrier.

20 Claims, 11 Drawing Sheets

ANTENNA STRUCTURE FOR CONCURRENT CHANNEL COMMUNICATION

BACKGROUND

In a single antenna communication system, a single transmitter communicates with a single receiver over a communication channel. In a multiple antenna communication system, multiple transmitters communicate with one or more receivers over a communication channel. A growing number of devices include spatially separated antennas in an antenna array to communicate in the multiple antenna communication system. The signals from the antennas may be processed to send and receive an increased amount of data between devices.

BRIEF DESCRIPTION OF DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1A:
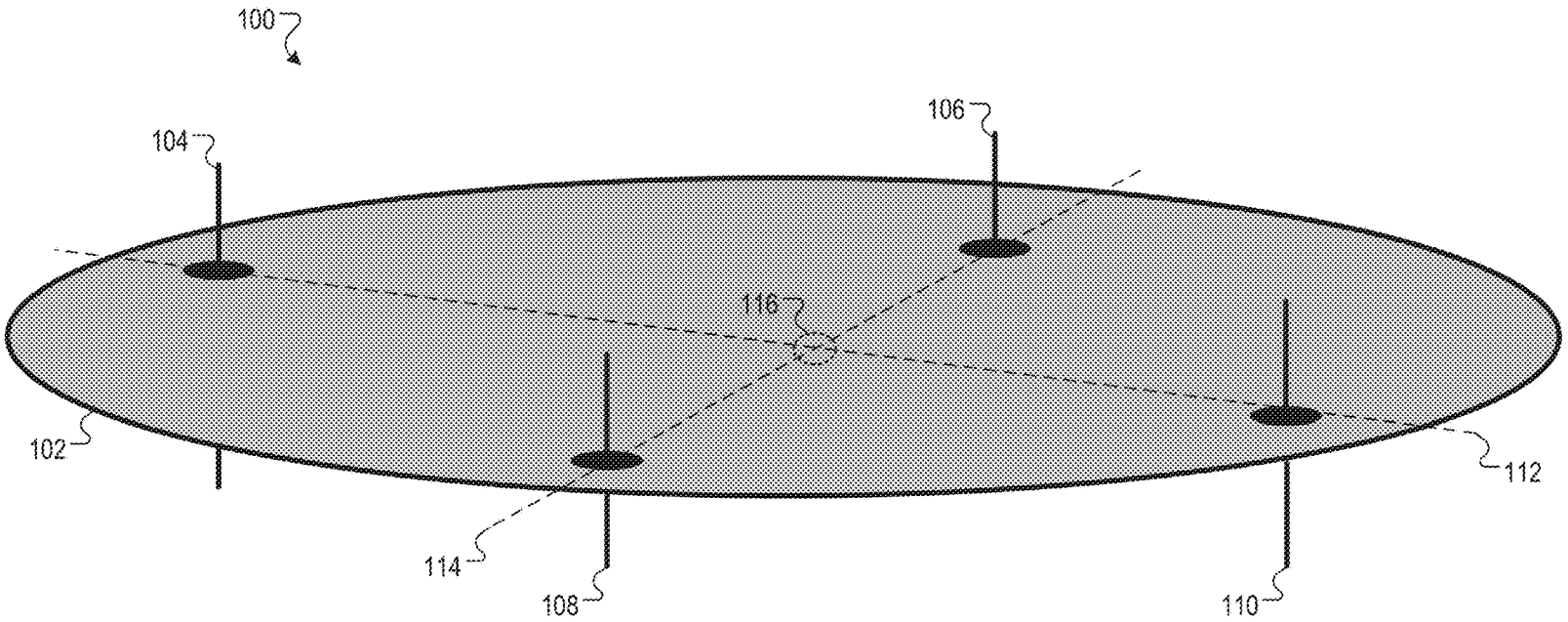
FIG. 1A illustrates an antenna carrier structure with a first antenna, a second antenna, a third antenna, and a fourth antenna, according to an embodiment.

Many electronic devices have multiple antennas configured to transmit and receive signals at different frequencies and for different types of communications networks. The electronic devices (e.g., user devices) can be electronic book readers, cellular telephones, personal digital assistants (PDAs), portable media players, tablet computers, netbooks, laptops, and so forth. To wirelessly communicate with other devices, these electronic devices can include multiple antennas, such as personal area network (PAN) antennas, wireless area network (WAN) antennas, wireless local area network (WLAN) antennas, and/or cellular network antennas. The antennas may be configured to communicate on one or more types of communication networks, such as communications networks using the Bluetooth® technology, the Zigbee® technology, the Wi-Fi® technology, or various cellular communication technologies.

The electronic devices may have multiple data streams to transmit at any given time. For example, an electronic device may have a queue of data streams to transmit and receive that include a first data stream for a multiple player gaming application that is to be sent to a server over a first communication channel, a second data stream for the multiple player gaming application that is to be received from the server over a second communication channel, and a third data stream for a text messaging application that is to be received from another device over a third communication channel. It may be desirable to communicate the first data stream, the second data stream, and the third data stream at the same time so that the applications are not delayed, however transmitting multiple data streams over multiple communication channels at the same time may be difficult. For example, when the multiple data streams are for communication channels within the same bandwidth range or frequency range, the multiple data streams may interfere with each other and increase an amount of noise over the communication channels.

To avoid the multiple data streams interfering with each other, a conventional communication system may include a processor to schedule different times to transmit or receive the different data streams. In one example, the processor may schedule the first data stream to be transmitted first, the second data stream to be received second, and the third data stream to be received third. In another example, the processor may schedule alternating transmitting or receiving portions of the data streams until the data streams are completely transmitted or received. However, scheduling the transmitting or receiving of different data streams at different times may be complex. Additionally, execution of the applications may be delayed as the data streams from the applications wait in a queue.

Alternatively, a communication system may be configured to transmit or receive multiple data streams at the same time. In one example, a communication system may include a self-interference cancellation system with a cancellation circuit to prevent the saturation of a signal at a receiver of the device. In another example, the communication system may include a dual polarized antenna with a cancellation circuit to reduce interference while transmitting a first data stream and receiving a second data stream. In another example, the communication system may include a set of switches to delay the transmitting or receiving of different data streams so that the data streams are transmitted or received at different times. These communication systems for transmitting or receiving multiple data streams at the same time may be complex, expensive, and may not provide adequate isolation between the different data streams.

The embodiments described herein may, therefore, include an electronic device using an antenna carrier structure with multiple antennas that may be employed to transmit and receive multiple data streams at the same time. The antennas of the antenna carrier structure may be symmetrically located along different axes of relative antenna carriers to provide adequate isolation between the communication channels. The symmetric location of the antennas may enable the electronic device to have an increased channel capacity to simultaneously transmit or receive different data streams using different antennas of the antenna carrier structure.

FIG. 1A illustrates an antenna carrier structure 100 with a first antenna 104, a second antenna 106, a third antenna 108, and a fourth antenna 110, according to an embodiment. The first antenna 104, the second antenna 106, the third antenna 108, and the fourth antenna 110 may be located on an antenna carrier 102. In one embodiment, the antenna carrier 102 may be a circuit board, a printed circuit board, a substrate, and so forth. In another example, the antenna carrier 102 may be a plastic material, a metal material, and so forth. In another example, the antenna carrier 102 may be a ground plane for one or more of the antennas 104-110. For example, when the antennas 104-110 are slot antennas, the antenna carrier 102 may be a ground plane.

In one embodiment, the first antenna 104, the second antenna 106, the third antenna 108, and the fourth antenna 110 may be dipole antennas, slot antennas, monopole antennas, and so forth. In another embodiment, when the first antenna 104, the second antenna 106, the third antenna 108, and the fourth antenna 110 are dipole antennas, the first antenna 104, the second antenna 106, the third antenna 108, and the fourth antenna 110 may be dipole antennas may have a variety of orientations. In one example, the first antenna 104, the second antenna 106, the third antenna 108, and the fourth antenna 110 may each be dipole antennas that are perpendicular to a plane of the antenna carrier 102. In another example, the first antenna 104, the second antenna 106, the third antenna 108, and the fourth antenna 110 may each be dipole antennas that are oriented parallel to the plane of the antenna carrier 102.

In one embodiment, the first antenna 104, the second antenna 106, the third antenna 108, and the fourth antenna 110 may be symmetrically located on the antenna carrier 102. In one example, the first antenna 104 and the fourth antenna 110 may be a first pair of antennas that are symmetrically located along a first axis 112. The first axis 112 may be coplanar to the antenna carrier 102 and run horizontally through the antenna carrier 102 in a first direction through a center of the antenna carrier 102. The first antenna 104 and the fourth antenna 110 may be located at approximately the same distance from a center 116 of the antenna carrier 102 along the first axis 112. In another example, the second antenna 106 and the third antenna 108 may be a second pair of antennas that are symmetrically located along a second axis 114. The second axis 114 may be coplanar to the antenna carrier 102 and run horizontally through the antenna carrier 102 in a second direction through a center of the antenna carrier 102. The second antenna 106 and the third antenna 108 may be located at approximately the same distance from the center 116 of the antenna carrier 102 along the second axis 114. In one embodiment, the first antenna 104, the second antenna 106, the third antenna 108, and the fourth antenna 110 may be located equidistantly from each other. In another embodiment, the first antenna 104, the second antenna 106, the third antenna 108, and the fourth antenna 110 may be located equidistantly from the center 116 of the antenna carrier 102.

The first pair of antennas may be connected to a first radio and the second pair of antennas may be connected to a second radio, as discussed below. The first radio may be used to communicate data over a first type of communication channel. For example, the first type of communication channel may be a first communication channel for a signal communicated in a PAN, a WAN, a WLAN, and so forth. In one example, the signal may be an radio frequency (RF) signal. The second radio may be for a second type of communication channel. For example, the first type of communication channel may be a second communication channel for a signal communicated in the PAN, the WAN, the WLAN, and so forth. In one embodiment, the first communication channel and the second communication channel may be the same type of communication channel. In another embodiment, the first communication channel and the second communication channel may be for different types of communication channels.

The symmetric locations of the first antenna 104, the second antenna 106, the third antenna 108, and the fourth antenna 110 along the antenna carrier 102 may enable the first radio to transmit a first signal using the first antenna pair concurrent to the second radio transmitting a second signal using the second antenna pair. To concurrently transmit the first signal and the second signal, the symmetric locations of the first antenna 104, the second antenna 106, the third antenna 108, and the fourth antenna 110 provide nulls in the radiation patterns of the first signal and the second signal. In one example, the nulls in the radiation patterns are locations where the signals from the first antenna 104, the second antenna 106, the third antenna 108, and the fourth antenna 110 cancel out. The nulls may shield antennas from interference while other antennas are transmitting. For example, the locations of the first antenna 104 and the fourth antenna 110, of which the first antenna 104 or the fourth antenna 110 may receive a signal with a 180 degree phase shift, may provide for nulls at the locations of the second antenna 106 and the third antenna 108. When the first antenna 104 and the fourth antenna 110 are used to transmit a first signal, the nulls in the radiation pattern shield the second antenna 106 and the third antenna 108 from interference. Similarly, the locations of the second antenna 106 and the third antenna 108, of which the second antenna 106 or the third antenna 108 may receive a signal with a 180 degree phase shift, provide for nulls at the locations of the first antenna 104 and the fourth antenna 110. When the second antenna 106 and the third antenna 108 are used to transmit a second signal, the nulls in the radiation pattern shield the first antenna 104 and the fourth antenna 110 from interference.

As the first signal from the first antenna 104 and the fourth antenna 110 and the second signal from the second antenna 106 and the third antenna 108 do not interfere with each other, the first signal and the second signal may be transmitted independent of each other. In one example, while the first signal is being transmitted via the first antenna 104 and the fourth antenna 110 for a transmission period, the second signal may be transmitted via the second antenna 106 and the third antenna 108 at any point in time during the transmission period of the first signal. In another example, a device may transmit the first signal and the second signal simultaneously where an interference level between the first signal and the second signal is below a threshold interference level.

In one embodiment, the locations of the antennas 104-110 may be spaced at minimum distances apart from each other to avoid mutual coupling between one or more of the antennas 104-110. In one example, the minimum distance between each of the antennas 104-110 may be half the length of the wave length of the electromagnetic energy radiated from the antennas 104-110. For example, when the antennas 104-110 transmit signals at 2.4 gigahertz (GHz), the length of the wavelength may be 12.5 centimeters (cm) and the antennas may be spaced apart by at least 6.25 cm. In another example, the distance that the antennas 104-110 are spaced apart may vary in view of the size of the antennas 104-110. For example, when the antennas are relatively small, the distance between the antennas may be reduced to one tenth the length of the wave length of the electromagnetic energy radiated from the antennas 104-110. In one embodiment, the diameter of the antennas may be approximately one tenth the length of a wavelength the antenna may transmit. In another embodiment, a longitudinal length of the antennas may be approximately one tenth the length of a wavelength the antenna may transmit and the distance between the antennas in the latitudinal direction may be less than 0 one tenth the length of a wavelength the antenna may transmit.

Figure 1B:
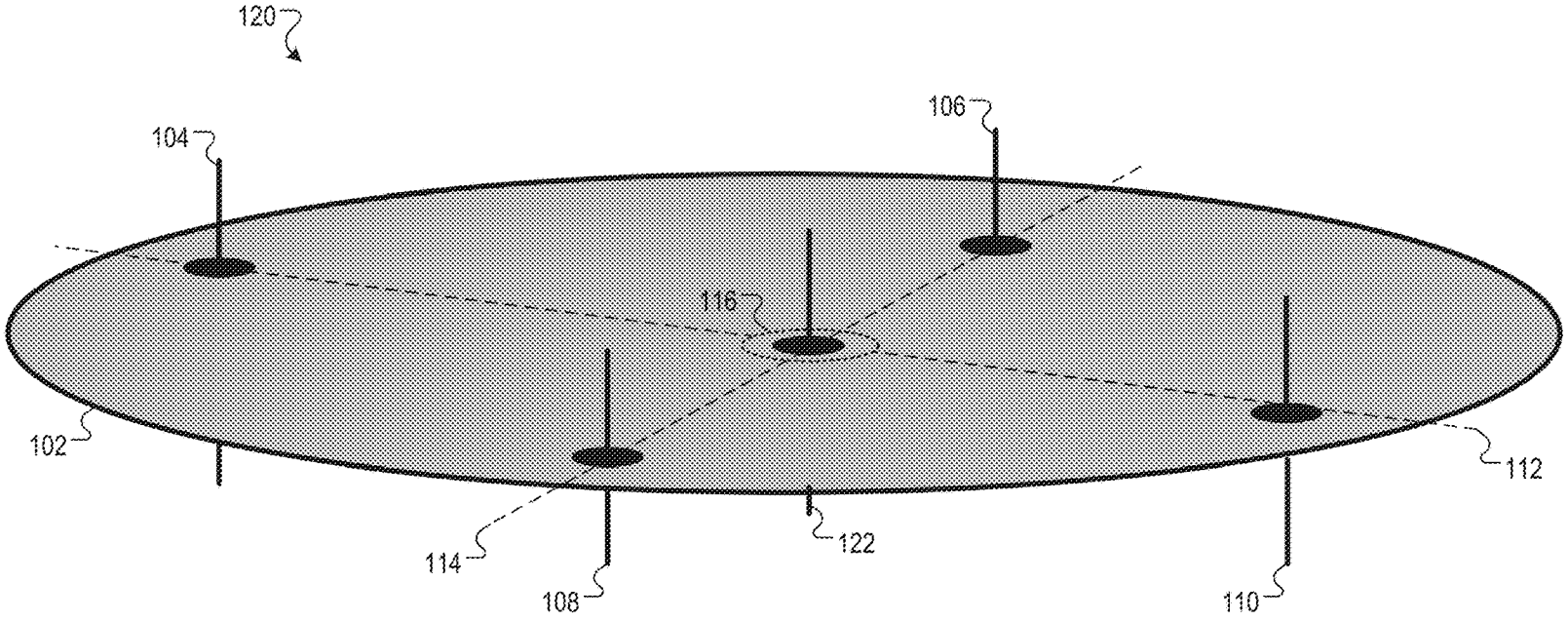
FIG. 1B illustrates an antenna carrier structure with the first antenna, the second antenna, the third antenna, the fourth antenna, and a fifth antenna according to an embodiment.

FIG. 1B illustrates an antenna carrier structure 120 with the first antenna 104, the second antenna 106, the third antenna 108, the fourth antenna 110, and a fifth antenna 122 according to an embodiment. Some of the features in FIG. 1B are the same or similar to some of the features in FIG. 1A as noted by same reference numbers, unless expressly described otherwise.

In one embodiment, the first antenna 104, the second antenna 106, the third antenna 108, the fourth antenna 110, and the fifth antenna 122 may be symmetrically located on an antenna carrier 102. The fifth antenna 122 may be located at a center of the antenna carrier 102. The center of the antenna carrier 102 may be a null between antennas 104-110.

In one example, the first antenna 104 and the fourth antenna 110 may be a first pair of antennas that are symmetrically located along the first axis 112 and may be located at approximately the same distance from the fifth antenna 122 along the first axis 112. In another example, the second antenna 106 and the third antenna 108 may be a second pair of antennas that are symmetrically located along a second axis 114 and may be located at approximately the same distance from the fifth antenna 122 along the second axis 114. In one embodiment, the first antenna 104, the second antenna 106, the third antenna 108, and the fourth antenna 110 may be located equidistantly from each other. In another embodiment, the first antenna 104, the second antenna 106, the third antenna 108, and the fourth antenna 110 may be located equidistantly from the fifth antenna 122.

Figure 1C:
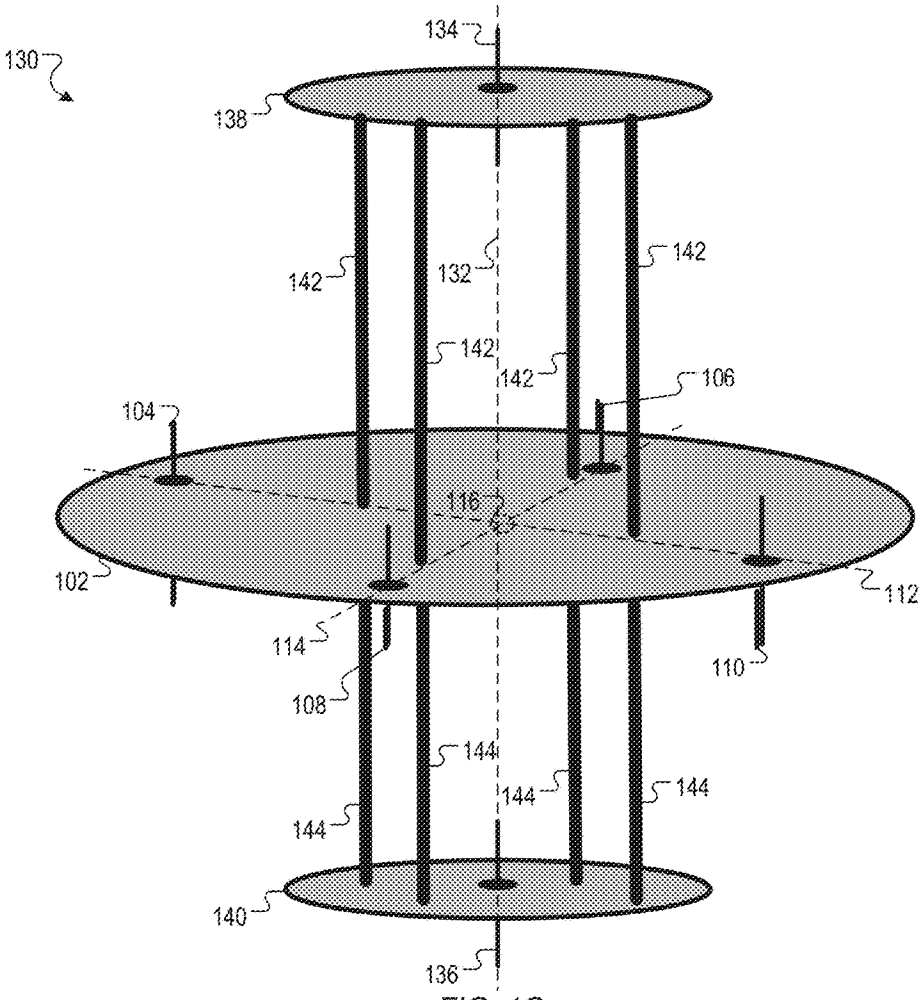
FIG. 1C illustrates an antenna carrier structure with the first antenna, the second antenna, the third antenna, the fourth antenna, a sixth antenna, and a seventh antenna according to an embodiment.

FIG. 1C illustrates an antenna carrier structure 130 with the first antenna 104, the second antenna 106, the third antenna 108, the fourth antenna 110, a sixth antenna 134, and a seventh antenna 136 according to an embodiment. Some of the features in FIG. 1C are the same or similar to some of the features in FIG. 1A as noted by same reference numbers, unless expressly described otherwise.

The first antenna 104, the second antenna 106, the third antenna 108, and the fourth antenna 110 may be located on the antenna carrier 102. The sixth antenna 134 may be located on a second antenna carrier 138. In one embodiment, the second antenna carrier 138 may be a circuit board, a printed circuit board, a substrate, and so forth. In another example, the second antenna carrier 138 may be a plastic material, a metal material, and so forth.

In one embodiment, the antenna carrier 102, the second antenna carrier 138, and the third antenna carrier 140 may be located on different planes. For example, the antenna carrier 102 may be located on a first plane, the second antenna carrier 138 may be located on a second plane that is above the first plane. The third antenna carrier 140 may be located on a third plane that is below the first plane. The second plane and the third plane may each be parallel to and equidistant from the first plane.

In one embodiment, the first antenna 104, the second antenna 106, the third antenna 108, the fourth antenna 110, the sixth antenna 134, and the seventh antenna 136 may be symmetrically located on the antenna carriers 102, 134, and 140, relative to the center of the antenna carrier 102. In one example, the sixth antenna 134 and the seventh antenna 136 may be a third pair of antennas that are symmetrically located along a third axis 132. The third axis 132 may be perpendicular to the antenna carrier 102 and run vertically through the center 116 of the antenna carrier 102. The sixth antenna 134 and the seventh antenna 136 may be located at approximately the same distance from a center 116 of the antenna carrier 102 along the third axis 132.

In one embodiment, the first antenna 104, the second antenna 106, the third antenna 108, the fourth antenna 110, the sixth antenna 134 and the seventh antenna 136 may be located equidistantly from each other. In another embodiment, the first antenna 104, the second antenna 106, the third antenna 108, the fourth antenna 110, the sixth antenna 134 and the seventh antenna 136 may be located equidistantly from the center 116 of the antenna carrier 102. In one embodiment, the sixth antenna 134 and the seventh antenna 136 may be located at nulls in the radiation patterns of the first antenna 104, the second antenna 106, the third antenna 108, and the fourth antenna 110.

The second antenna carrier 138 may be connected to the antenna carrier 102 by a first support structure 142. The first support structure 142 may include beams that support the second antenna carrier 138 at a location above the antenna carrier 102. In one embodiment, the beams of the first support structures 142 may be a circuit board, a printed circuit board, a substrate, and so forth. In another embodiment, the beams of the first support structure 142 may be a plastic material, a metal material, and so forth.

The second support structures 144 may include beams that support the third antenna carrier 140 in a location below the antenna carrier 102. In one embodiment, the beams of the second support structures 144 may be a circuit board, a printed circuit board, a substrate, and so forth. In another example, the beams of the second support structure 144 may be a plastic material, a metal material, and so forth.

The seventh antenna 136 may be located on a third antenna carrier 140. In one embodiment, the third antenna carrier 140 may be a circuit board, a printed circuit board, a substrate, and so forth. In another example, the third antenna carrier 140 may be a plastic material, a metal material, and so forth. The third antenna carrier 140 may be connected to the antenna carrier 102 by a second support structure 144.

The beams of the first support structure 142 may be symmetrically located along the first axis 112. In one embodiment, the beams of the first support structure 142 or the second support structure 144 may be equidistant from the center 116. In another embodiment, the beams of the first support structure 142 or the second support structure 144 may be symmetrically located along the first axis 112 and second axis 114. For example, when the first support structure 142 includes 4 beams or tubes, the first beam may be located at half the distance between the center 116 and the first antenna 104, the second beam may be located at half the distance between the center 116 and the second antenna 106, the third beam may be located at half the distance between the center 116 and the third antenna 108, and the fourth beam may be located at half the distance between the center 116 and the fourth antenna 110

Figure 1D:
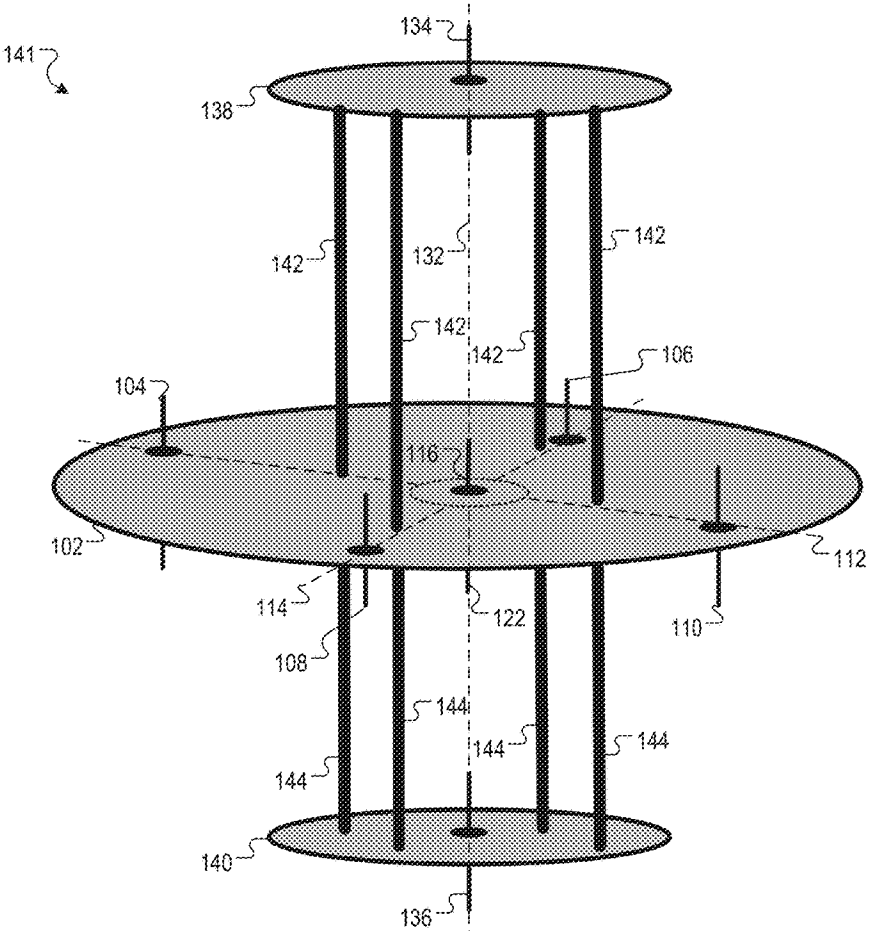
FIG. 1D illustrates an antenna carrier structure with the first antenna, the second antenna, the third antenna, the fourth antenna, the fifth antenna, the sixth antenna, and the seventh antenna according to an embodiment.

FIG. 1D illustrates an antenna carrier structure 141 with the first antenna 104, the second antenna 106, the third antenna 108, the fourth antenna 110, the fifth antenna 122, the sixth antenna 134, and the seventh antenna 136 according to an embodiment. Some of the features in FIG. 1D are the same or similar to some of the features in FIG. 1A-1C as noted by same reference numbers, unless expressly described otherwise.

In one embodiment, the first antenna 104, the second antenna 106, the third antenna 108, the fourth antenna 110, the fifth antenna 122, the sixth antenna 134, and the seventh antenna 136 may be symmetrically located relative to the center 116 of the antenna carrier 102. The fifth antenna 122 may be located at a center of the antenna carrier 102. The first antenna 104, the second antenna 106, the third antenna 108, the fourth antenna 110, the sixth antenna 134, and the seventh antenna 136 may be symmetrically located relative to the fifth antenna 122.

In one example, the fifth antenna 122 may be an individual antenna. In another example, the first antenna 104 and the fourth antenna 110 may be a first pair of antennas that may be symmetrically located along the first axis 112 and may be located at approximately the same distance from the fifth antenna 122. In another example, the second antenna 106 and the third antenna 108 may be a second pair of antennas that are symmetrically located along a second axis 114 and may be located at approximately the same distance from the fifth antenna 122. In another example, the sixth antenna 134 and the seventh antenna 136 may be a third pair of antennas that are symmetrically located along the third axis 132 and may be located at approximately the same distance from the fifth antenna 122. The number of antennas in the antenna carrier structure 141 is not intended to be limiting. For example, the antenna carrier structure 141 may include an eight antenna, a ninth antenna, a ten antenna, and an eleventh antenna that are symmetrically spaced along the antenna carrier 102, similar to the symmetric spacing of the first antenna 104, the second antenna 106, the third antenna 108, the fourth antenna 110, as discussed above.

Figure 1E:
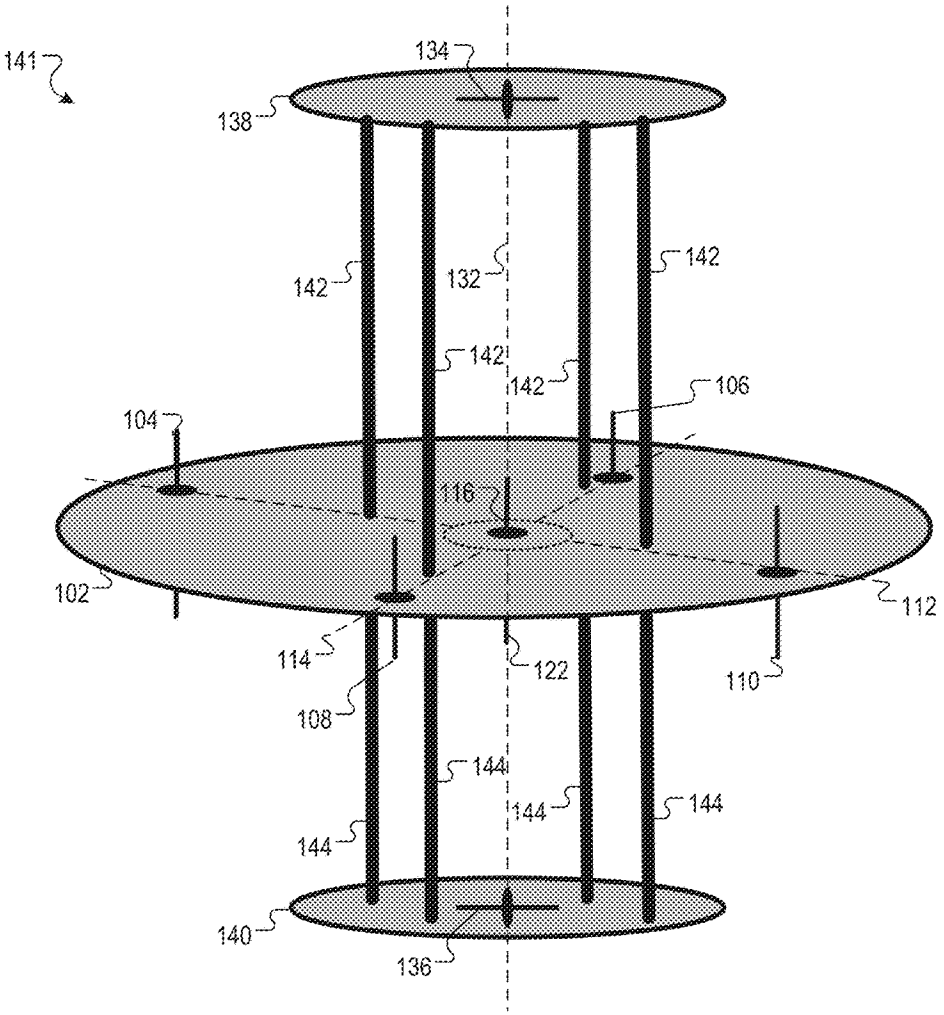
FIG. 1E illustrates an antenna carrier structure with the first antenna, the second antenna, the third antenna, the fourth antenna, and the fifth antenna with a first orientation and the sixth antenna and the seventh antenna with a second orientation according to an embodiment.

FIG. 1E illustrates the antenna carrier structure 141 with the first antenna 104, the second antenna 106, the third antenna 108, the fourth antenna 110, and the fifth antenna 122 with a first orientation and the sixth antenna 134 and the seventh antenna 136 with a second orientation according to an embodiment. Some of the features in FIG. 1E are the same or similar to some of the features in FIG. 1A-1D as noted by same reference numbers, unless expressly described otherwise.

In one embodiment, the first antenna 104, the second antenna 106, the third antenna 108, the fourth antenna 110, and the fifth antenna 122 may have a first orientation. In one example, the first antenna, the second antenna 106, the third antenna 108, the fourth antenna 110, and the fifth antenna 122 may be dipole antennas where the dipole antennas are oriented perpendicular to a plane of the antenna carrier 102, e.g. a 90 degree orientation relative to the plane of the antenna carrier 102. In another example, the first antenna, the second antenna 106, the third antenna 108, the fourth antenna 110, and the fifth antenna 122 may be dipole antennas where the dipole antennas are oriented parallel to a plane of the antenna carrier 102.

In another embodiment, the sixth antenna 134 and the seventh antenna 136 may have a second orientation. In one example, the sixth antenna 134 may be a dipole antenna that is oriented parallel to a plane of the second antenna carrier 138. In another example, the seventh antenna 136 may be a dipole antenna that is oriented parallel to a plane of the third antenna carrier 140, respectively. In another example, the sixth antenna 134 and the seventh antenna 136 may be dipole antennas where the dipole antennas may be oriented 90 degrees clockwise or counterclockwise relative to the first orientation of the first antenna 104, the second antenna 106, the third antenna 108, the fourth antenna 110, and the fifth antenna 122. When the sixth antenna 134 is oriented parallel to a plane of the second antenna carrier 138, the second antenna carrier 138 may be electrically non-conductive material. When the seventh antenna 136 is oriented parallel to a plane of the third antenna carrier 140, the third antenna carrier 140 may be electrically non-conductive material. The electrically non-conductive material may be plastic, glass, paper, and so forth.

Figure 1F:
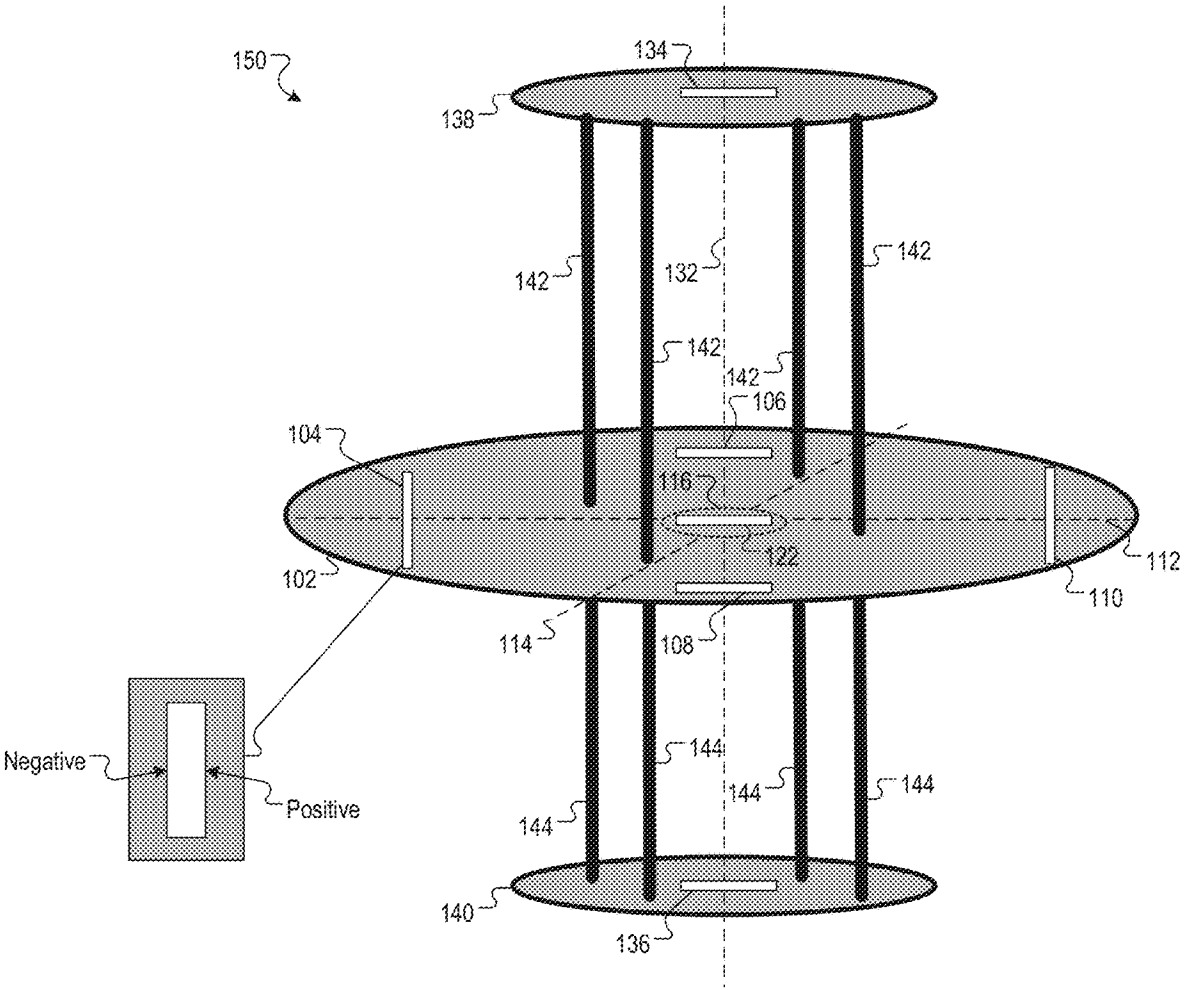
FIG. 1F illustrates an antenna carrier structure with the first antenna, the second antenna, the third antenna, the fourth antenna, the fifth antenna, the sixth antenna, and the seventh antenna according to an embodiment.

FIG. 1F illustrates an antenna carrier structure 150 with the first antenna 104, the second antenna 106, the third antenna 108, the fourth antenna 110, the fifth antenna 122, the sixth antenna 134, and the seventh antenna 136 according to an embodiment. Some of the features in FIG. 1F are the same or similar to some of the features in FIG. 1A-1E as noted by same reference numbers, unless expressly described otherwise.

The first antenna 104, the second antenna 106, the third antenna 108, the fourth antenna 110, the fifth antenna 122, the sixth antenna 134, and the seventh antenna 136 may be slot antennas. For example, the first antenna 104, the second antenna 106, the third antenna 108, the fourth antenna 110, the fifth antenna 122, the sixth antenna 134, and the seventh antenna 136 may be holes or slots cut out of the antenna carrier 102, the second antenna carrier 138, and the third antenna carrier 140, respectively.

In one embodiment, the antenna carrier 102, the second antenna carrier 138, and the third antenna carrier 140 may be metal plates. When currents are applied to the antenna carrier 102, the second antenna carrier 138, and the third antenna carrier 140, the first antenna 104, the second antenna 106, the third antenna 108, the fourth antenna 110, the fifth antenna 122, the sixth antenna 134, and the seventh antenna 136 may be excited as antennas by a driving frequency and the slots may radiate electromagnetic energy. The slots of the first antenna 104, the second antenna 106, the third antenna 108, the fourth antenna 110, the fifth antenna 122, the sixth antenna 134, and the seventh antenna 136 may receive signals from a differential port of one or more radios, as discussed below. The differential signals may be complementary signals. For example, each differential signal may include a positive signal and a negative signal. A first side of each of the slots of the first antenna 104, the second antenna 106, the third antenna 108, the fourth antenna 110, the fifth antenna 122, the sixth antenna 134, and the seventh antenna 136 may be connected to a port of a radio and may receive a positive signal. In one embodiment, a second side of each of the slots of the first antenna 104, the second antenna 106, the third antenna 108, the fourth antenna 110, the fifth antenna 122, the sixth antenna 134, and the seventh antenna 136 may be connected to the port of the radio and receive a negative signal. In another embodiment, a second side of each of the slots of the first antenna 104, the second antenna 106, the third antenna 108, the fourth antenna 110, the fifth antenna 122, the sixth antenna 134, and the seventh antenna 136 may be connected to a negative terminal or a ground.

The shape and size of the slots are not intended to be limiting. For example, the shape and size of the slots may vary to radiate the electromagnetic energy at different frequencies or with different radiation patterns.

Figure 1G:
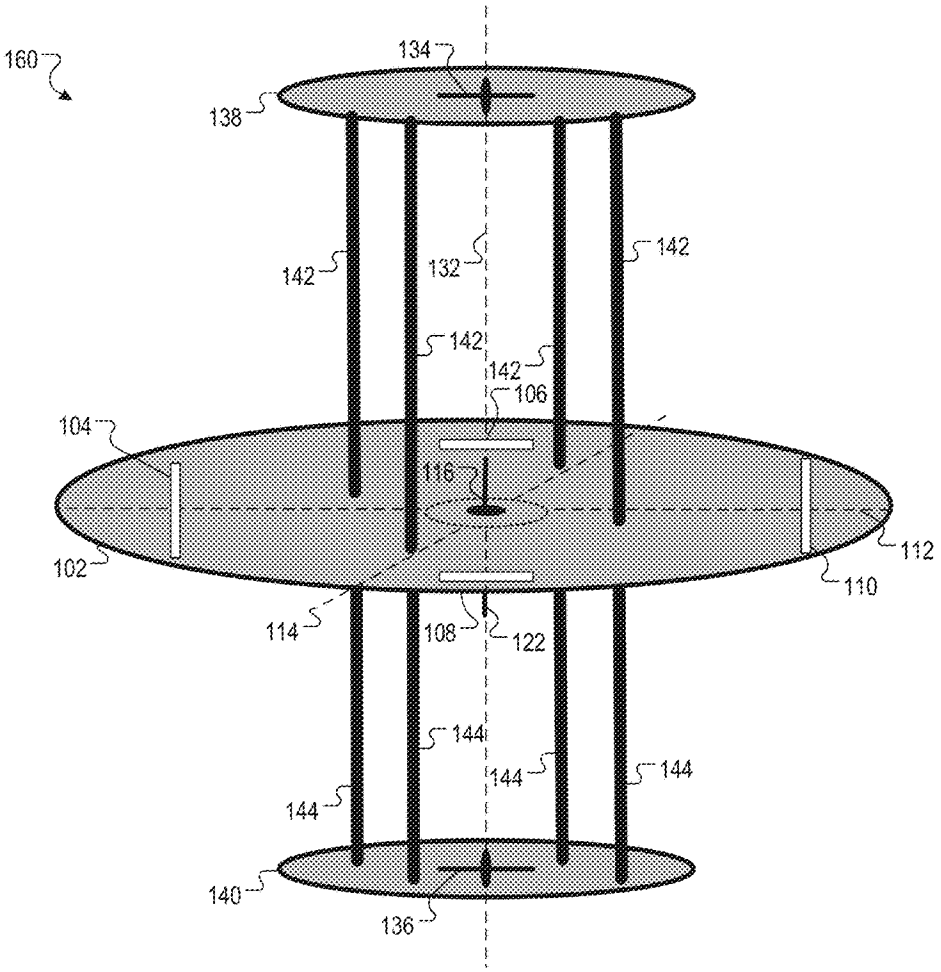
FIG. 1G illustrates an antenna carrier structure with the first antenna, the second antenna, the third antenna, the fourth antenna, the fifth antenna, the sixth antenna, and the seventh antenna according to an embodiment.

FIG. 1G illustrates an antenna carrier structure 160 with the first antenna 104, the second antenna 106, the third antenna 108, the fourth antenna 110, the fifth antenna 122, the sixth antenna 134, and the seventh antenna 136 according to an embodiment. Some of the features in FIG. 1G are the same or similar to some of the features in FIG. 1A-1F as noted by same reference numbers, unless expressly described otherwise.

In one embodiment, the first antenna 104, the second antenna 106, the third antenna 108, the fourth antenna 110 may be slot antennas. For example, the antenna carrier 102 may be a metal plate. The first antenna 104, the second antenna 106, the third antenna 108, and the fourth antenna 110 may be holes or slots cut out of the antenna carrier 102. The fifth antenna 122 may be a dipole antenna with a first orientation. For example, the fifth antenna 122 may be orientated to be perpendicular to a plane of the antenna carrier 102. The sixth antenna 134 and the seventh antenna 136 may be dipole antennas with a second orientation. For example, the sixth antenna 134 and the seventh antenna 136 may be oriented to be parallel to the planes of the second antenna carrier 138 and the third antenna carrier 140, respectively. In another example, the sixth antenna 134 and the seventh antenna 136 may be rotated to have an orientation that is 90 degrees clockwise or counterclockwise relative to the fifth antenna 122.

Figure 2:
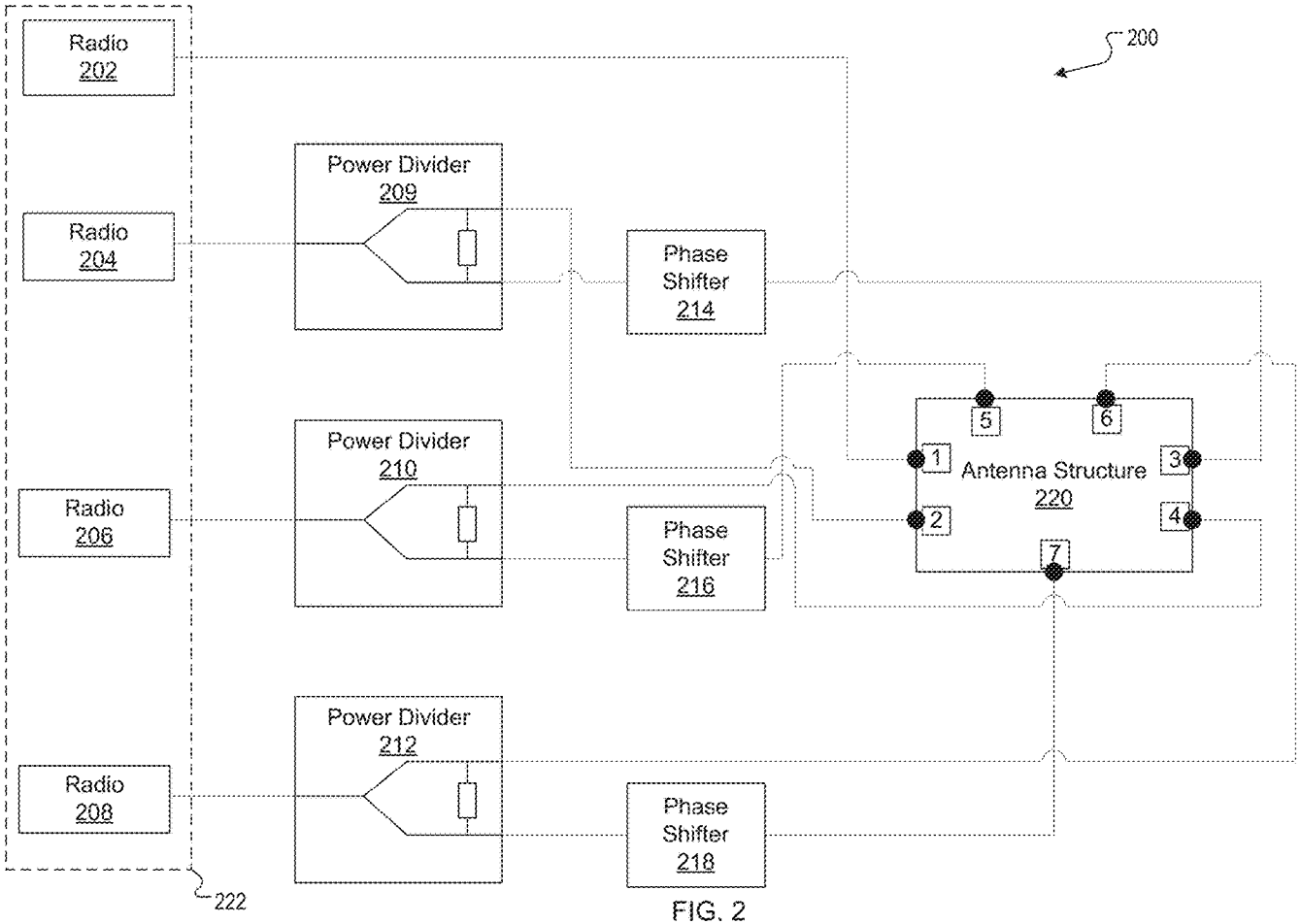
FIG. 2 illustrates a communication device for simultaneous transmission by multiple radios using an antenna structure according to an embodiment.

FIG. 2 illustrates a communication device 200 for simultaneous transmission by multiple radios 202-208 using an antenna structure 220 according to an embodiment. The communication device 200 may include a first radio 202, a second radio 204, a third radio 206, and a fourth radio 208. In one embodiment, a port of the first radio 202 may be coupled to a first radio frequency (RF) feed of the antenna structure 220. In one example, when the first radio 202 is transmitting data received from a processor, the first radio 202 may generate a first signal associated with the data and output the first signal to the first RF feed. An antenna of the antenna structure 220 may radiate electromagnetic energy when the first signal is received at the first RF feed. In one example, the fifth antenna 122 in FIG. 1B, 1D, 1E, 1F, or 1G may be coupled to the first RF feed of the antenna structure 220.

A port of the second radio 204 may be coupled to a first power divider 209. In one example, when the second radio 204 is transmitting data received from a processor, the second radio 204 may generate a second signal associated with the data and output the second signal from the first port to the first power divider 209. The first power divider 209 may divide the second signal into a first portion of the second signal and a second portion of the second signal.

A first output of the first power divider 209 may be coupled to a second RF feed of the antenna structure 220. The first power divider 209 may output the first portion of the second signal to the second RF feed. In one example, the first antenna 104 in FIGS. 1A-1G may be coupled to the second RF feed. A second output of the first power divider 209 may be coupled to a first phase shifter 214. The first power divider 209 may output a second portion of the second signal to the first phase shifter 214. The first phase shifter 214 may adjust a phase of the first portion of the second signal to obtain a phase shifted portion of the second signal. In one example, the first phase shifter 214 may adjust a phase of the second portion of the second signal by 180 degrees relative to the first portion of the second signal. The first phase shifter 214 may output the phase shifted portion of the second signal to a third RF feed of the antenna structure 220. In one example, the fourth antenna 110 in FIGS. 1A-1G may be coupled to the second RF feed.

In one embodiment, the first power divider 209 and the first phase shifter 214 may be used to provide a phase shift (e.g. 180 degree) between the first antenna 104 and the fourth antenna 110. Additionally, the first phase shifter 214 may be used to adjust for imperfections in the communication device 200. For example, the imperfections may include asymmetrical device structures and non-identical antenna structures.

A port of the third radio 206 may be coupled to a second power divider 210. In one example, when the third radio 206 is transmitting data received from a processor, the third radio 206 may generate a third signal associated with the data and output the third signal at the second power divider 210. The second power divider 210 may divide the third signal into a first portion of the third signal and a second portion of the third signal.

A first output of the second power divider 210 may be coupled to a fourth RF feed of the antenna structure 220. The second power divider 210 may output the first portion of the third signal to the fourth RF feed. In one example, the second antenna 106 in FIGS. 1A-1G may be coupled to the fourth RF feed. A second output of the second power divider 210 may be coupled to a second phase shifter 216. The second power divider 210 may output a second portion of the second signal to the second phase shifter 216. The second phase shifter 216 may adjust a phase of the second portion of the third signal to obtain a phase shifted portion of the third signal. The second phase shifter 216 may output the phase shifted portion of the third signal to a fifth RF feed of the antenna structure 220. In one example, the third antenna 108 in FIGS. 1A-1G may be coupled to the third RF feed. The second power divider 210 and the second phase shifter 216 may be used to balance the second antenna 106 and the third antenna 108, similar to the balancing of the first antenna 104 and the fourth antenna 110, as discussed above.

A port of the fourth radio 208 may be coupled to a third power divider 212. In one example, when the fourth radio 208 is transmitting data received from a processor, the fourth radio 208 may generate a fourth signal associated with the data and output the fourth signal at the third power divider 212. The third power divider 212 may divide the fourth signal into a first portion of the fourth signal and a second portion of the fourth signal.

A first output of the third power divider 212 may be coupled to a sixth RF feed of the antenna structure 220. The third power divider 212 may output the first portion of the fourth signal to the sixth RF feed. In one example, the sixth antenna 134 in FIGS. 1C-1G may be coupled to the sixth RF feed. A second output of the third power divider 212 may be coupled to a third phase shifter 218. The third power divider 212 may output a second portion of the second signal to the third phase shifter 218. The third phase shifter 218 may adjust a phase of the second portion of the fourth signal to obtain a phase shifted portion of the fourth signal. The third phase shifter 218 may output the phase shifted portion of the fourth signal to a seventh RF feed of the antenna structure 220. In one example, the seventh antenna 136 in FIGS. 1C-1G may be coupled to the fourth RF feed.

In one embodiment, the first radio 202, the second radio 204, the third radio 206, and the fourth radio 208 may be a multi-channel single-chip radio 222 with multiple ports. The multi-channel single-chip radio 222 may be disposed on a circuit board and transmit or receive signals via the different paths to the antenna structure 220, as discussed above. The multi-channel single-chip radio 222 may transmit and/or receive on the multiple channels concurrently. For example, the multi-channel single-chip radio 222 may transmit over a first channel using the first antenna 104 and the fourth antenna 110, transmit over a second channel using the second antenna 106 and the third antenna 108, and receive over a third channel using the fifth antenna 122, and may receive over a fourth channel using the sixth antenna 134 and the seventh antenna 136.

In another embodiment, the first radio 202 may transmit or receive data using a first communication standard, such as a communication standard for a PAN network. The second radio 204 may transmit or receive data using a second communication standard, such as a communication standard for a WAN network. The third radio 206 may transmit or receive data using a third communication standard, such as a communication standard for a WLAN network. The fourth radio 208 may transmit or receive data using a fourth communication standard, such as a communication standard for a metropolitan area network (MAN). One or more of the first radio 202, the second radio 204, the third radio 206, or the fourth radio 208 may transmit and/or receive data on the multiple channels concurrently. In one example, the multiple channels of the first radio 202, the second radio 204, the third radio 206, and/or the fourth radio 208 may be for the same frequency or frequency range. In another example, the multiple channels of the first radio 202, the second radio 204, the third radio 206, and/or the fourth radio 208 may be for the same bandwidth or bandwidth range. Transmitting and/or receiving data on the multiple channels concurrently and within the same bandwidth may increase a data transfer rate of the communication device 200.

The number of transceivers, power dividers, phase shifters, and RF feeds is not intended to be limiting. For example, the communication device 200 may include a single power divider and phase shifter or multiple power dividers and phase shifters. In another example, the antenna structure 220 may include varying numbers of feed points, as discussed above.

Figure 3:
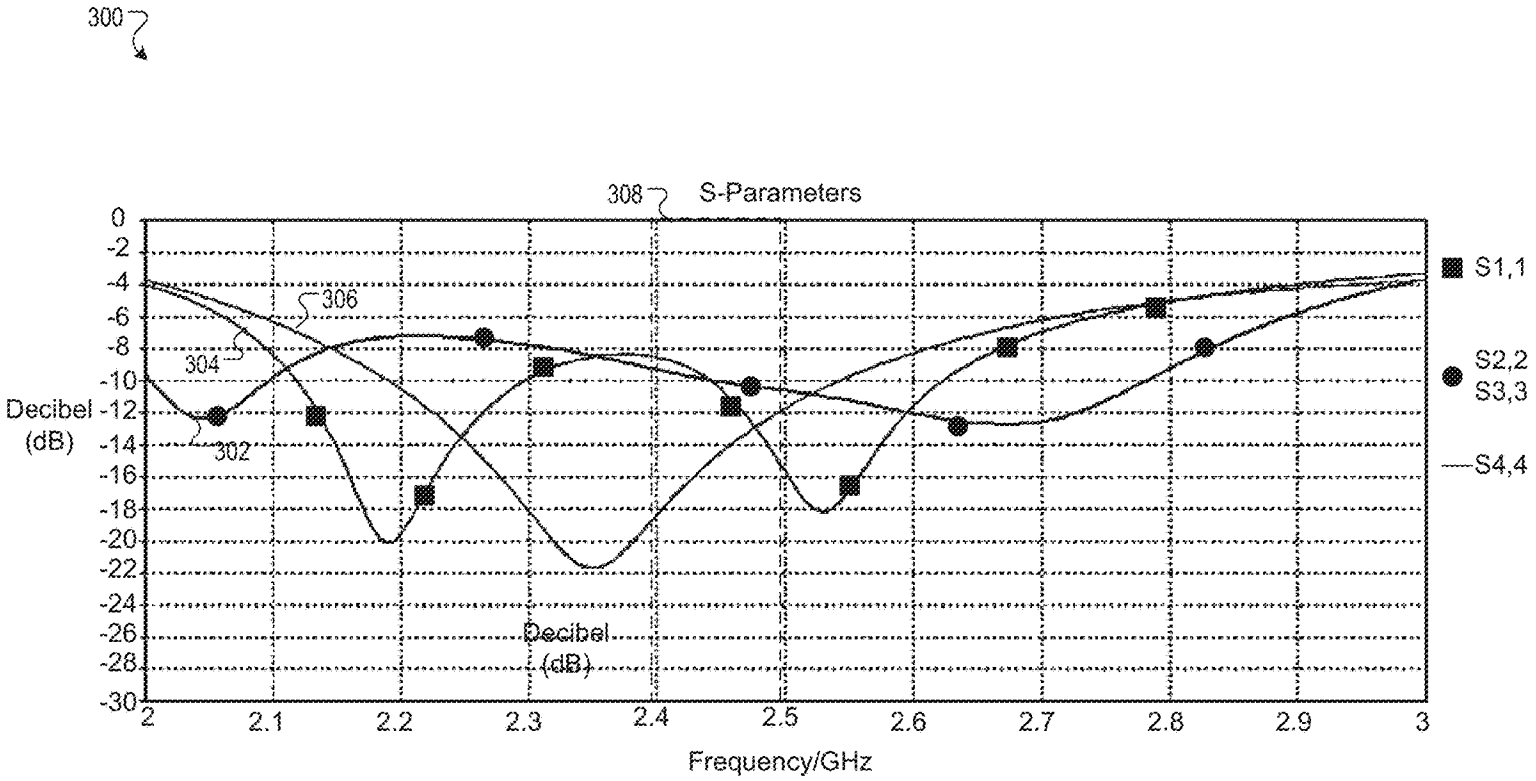
FIG. 3 illustrates is a graph of S-parameters for the antenna structure of the communication device in FIG. 2 according to one embodiment.

FIG. 3 illustrates is a graph 300 of S-parameters 302-306 for the antenna structure 220 of the communication device 200 (FIG. 2) according to one embodiment. The S-parameters indicates an amount of power reflected at antennas coupled to the ports of the radios 202-208 of the communication device 200. For example, S1,1 represents an amount of power reflected by the antenna coupled to the port of the first radio 202. In another example, S2,2 represents the amount of power reflected by the antennas indirectly coupled to the port of radio 204. In another example, S3,3 represents the amount of power reflected by the antennas indirectly coupled to the port of radio 206. In another example, S4,4 represents the amount of power reflected by the antennas indirectly coupled to the port of the fourth radio 208. The S-parameter 302 may indicate the same power is reflected by the antennas connected to the port of radio 204 and the port of radio 206 because the configuration of the antennas connected to the ports of radios 204 and 206 may be symmetric the same amount of power may be reflected by both pairs of antennas. The graph 300 may indicate that the S-parameters 302-306 are below −6 dB for frequencies between 2.4 GHz and 2.5 GHz.

Figure 4:
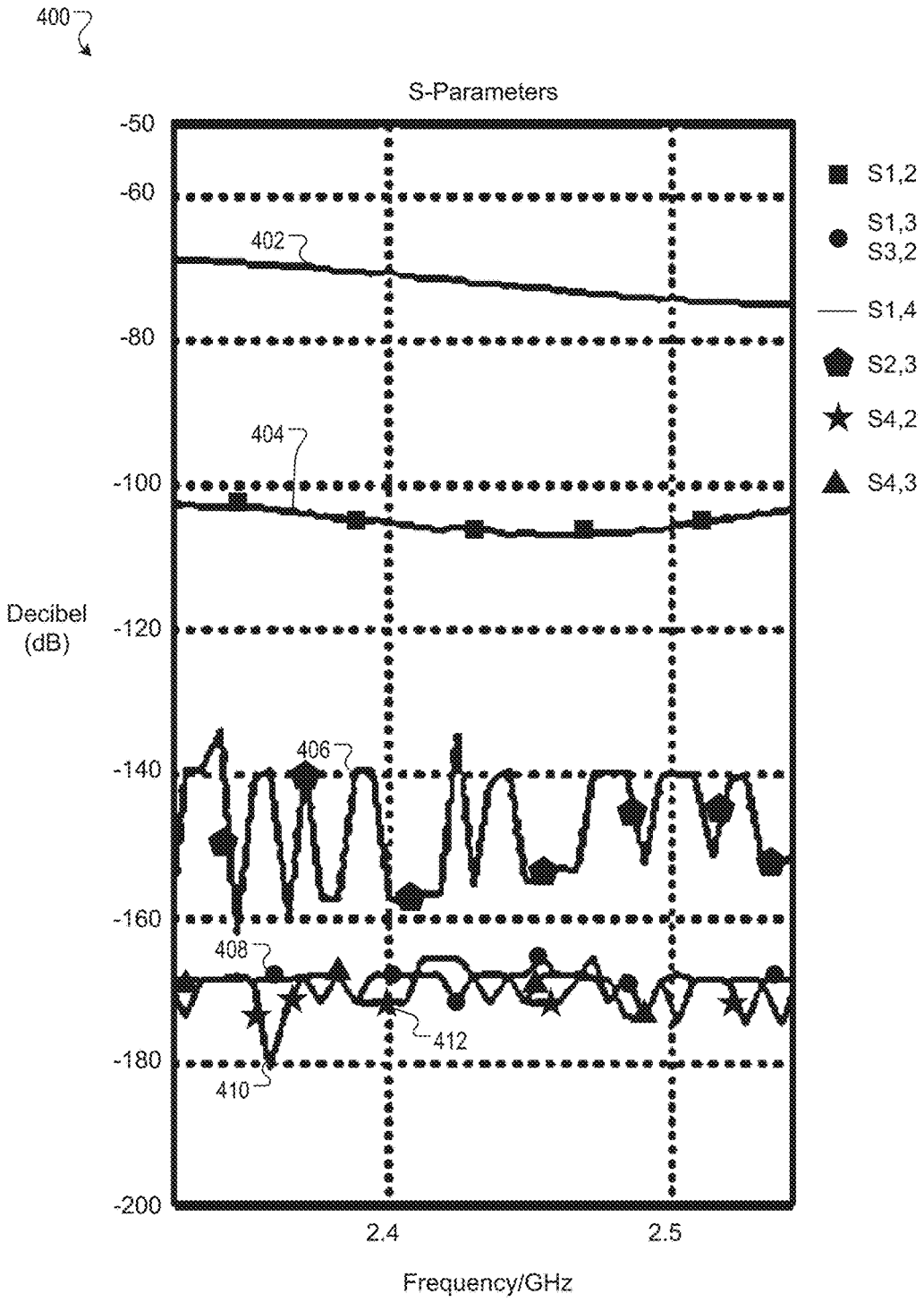
FIG. 4 is a graph of S-parameters for the antenna structure of the communication device in FIG. 2 according to one embodiment.

FIG. 4 is a graph 400 of S-parameters for the antenna structure 220 of the communication device 200 in FIG. 2 according to one embodiment. The S-parameters 402, 404, 406, 408, 410, and 412 may indicate the coupling of antennas connected to the different ports of the radios 202-208 (FIG. 2). For example, the S-parameter 402 (S1,4) may indicate the coupling between the antennas connected to the port of the first radio 202 and the antennas connected to the port of the fourth radio 208.

The S-parameter 402 for S1,4 may be between −70 dB and −75 dB for a frequency range of 2.4 Ghz to 2.5 GHz. The S-parameter 404 for S1,2 may be between −105 dB and −110 dB for a frequency range of 2.4 Ghz to 2.5 GHz. The S-parameter 406 for S2,3 may be between −140 dB and −158 dB for a frequency range of 2.4 Ghz to 2.5 GHz. The S-parameter 408 for S1,3 or S3,2 may be between −170 dB and −175 dB for a frequency range of 2.4 Ghz to 2.5 GHz. The S-parameter 408 may indicate the coupling between the antennas connected to the ports of radios 202 (S1,3) and 206 or the ports of radios 204 and 206 (S2,3) because the configuration of the antennas connected to the ports of 202 and 206 and the antennas connected to the ports of 204 and 206 may be symmetric and the antennas may have the same coupling coefficient. The S-parameter 410 for S4,2 may be between −170 dB and −180 dB for a frequency range of 2.4 Ghz to 2.5 GHz. The S-parameter 412 for S4,3 may be between −170 dB and −175 dB for a frequency range of 2.4 Ghz to 2.5 GHz. The S-parameters 402-412 illustrates an isolation of at least 60 dB between the ports of radios 202-208.

Figure 5:
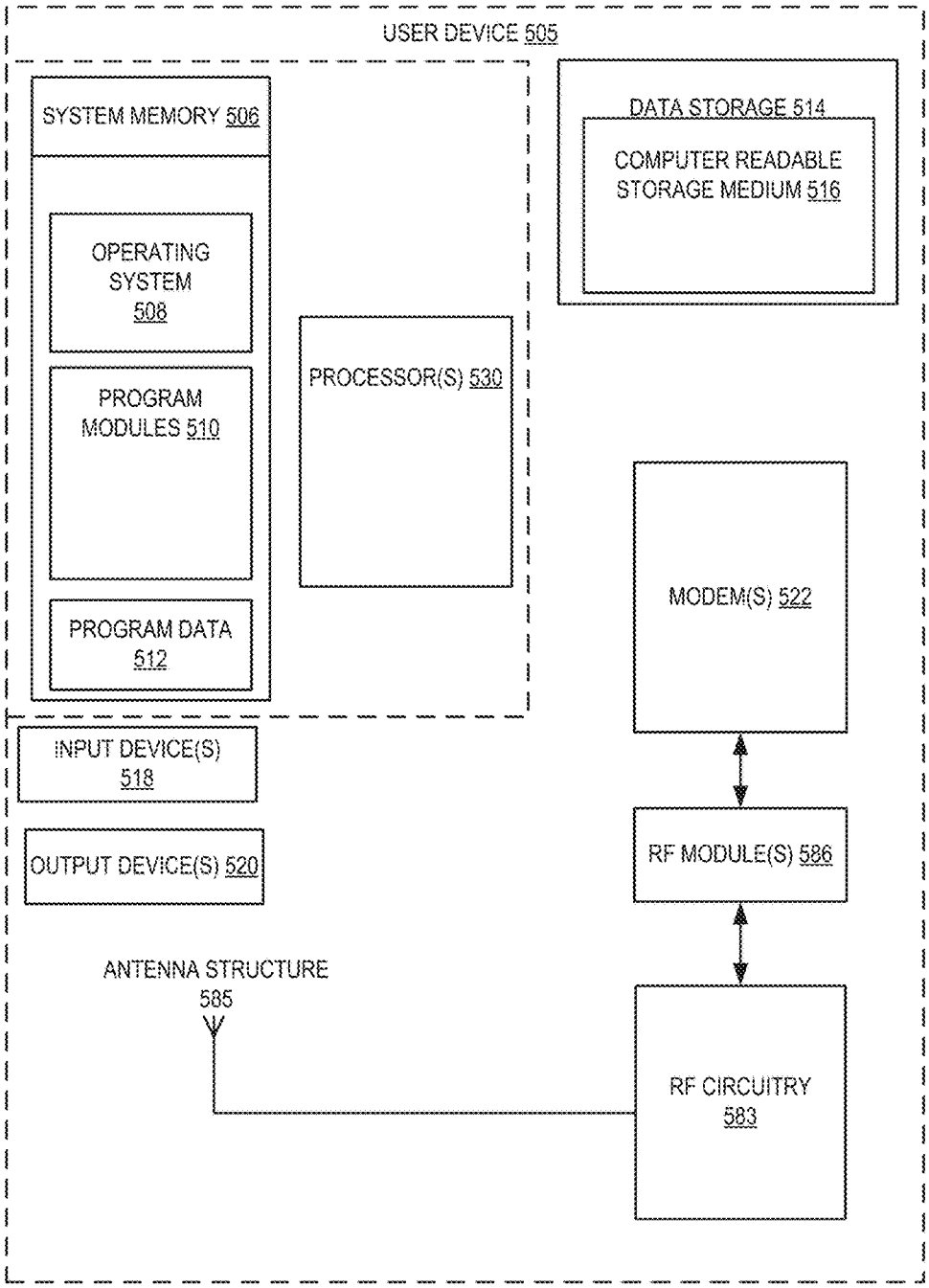
FIG. 5 is a block diagram of a user device in which embodiments of a radio device with the antenna structure may be implemented.

FIG. 5 is a block diagram of a user device 505 in which embodiments of a radio device with an antenna structure may be implemented. The user device 505 may correspond to the user device of FIG. 2. The antenna structure 585 of user device 505 may correspond to the antenna structures of FIGS. 1A-1G. The user device 505 may be any type of computing device such as an electronic book reader, a PDA, a mobile phone, a laptop computer, a portable media player, a tablet computer, a camera, a video camera, a netbook, a desktop computer, a gaming console, a DVD player, a computing pad, a media center, and the like. The user device 505 may be any portable or stationary user device. For example, the user device 505 may be an intelligent voice control and speaker system. Alternatively, the user device 505 can be any other device used in a WLAN network (e.g., Wi-Fi® network), a WAN network, or the like.

The user device 505 includes one or more processor(s) 530, such as one or more CPUs, microcontrollers, field programmable gate arrays, or other types of processors. The user device 505 also includes system memory 506, which may correspond to any combination of volatile and/or non-volatile storage mechanisms. The system memory 506 stores information that provides operating system component 508, various program modules 510, program data 512, and/or other components. In one embodiment, the system memory 506 stores instructions methods as described herein. The user device 505 performs functions by using the processor(s) 530 to execute instructions provided by the system memory 506.

The user device 505 also includes a data storage device 514 that may be composed of one or more types of removable storage and/or one or more types of non-removable storage. The data storage device 514 includes a computer-readable storage medium 516 on which is stored one or more sets of instructions embodying any of the methodologies or functions described herein. Instructions for the program modules 510 may reside, completely or at least partially, within the computer-readable storage medium 516, system memory 506 and/or within the processor(s) 530 during execution thereof by the user device 505, the system memory 506 and the processor(s) 530 also constituting computer-readable media. The user device 505 may also include one or more input devices 518 (keyboard, mouse device, specialized selection keys, etc.) and one or more output devices 520 (displays, printers, audio output mechanisms, etc.).

The user device 505 further includes modem 522 to allow the user device 505 to communicate via wireless network(s) (e.g., such as provided by the wireless communication system) with other computing devices, such as remote computers, an item providing system, and so forth. The modem 522 can be connected to zero or more RF modules 584. The zero or more RF modules 584 can be connected to zero or more coupler circuitry 586. The RF modules 584 and/or the coupler circuitry 586 may be a WLAN module, a WAN module, PAN module, or the like. Antenna coupler 588 is coupled to the coupler circuitry 586, which is coupled to the modem 522 via the RF modules 584. The modem 522 allows the user device 505 to handle both voice and non-voice communications (such as communications for text messages, multimedia messages, media downloads, web browsing, etc.) with a wireless communication system. The modem 522 may provide network connectivity using any type of mobile network technology including, for example, cellular digital packet data (CDPD), general packet radio service (GPRS), EDGE, universal mobile telecommunications system (UMTS), 1 times radio transmission technology (1×RTT), evaluation data optimized (EVDO), high-speed downlink packet access (HSDPA), Wi-Fi® technology, Long Term Evolution (LTE) and LTE Advanced (sometimes generally referred to as 4G), etc.

The modem 522 may generate signals and send these signals to antenna coupler 588 via coupler circuitry 586 as described herein. User device 505 may additionally include a WLAN module, a GPS receiver, a PAN transceiver and/or other RF modules. The coupler circuitry 586 may additionally or alternatively be connected to one or more of antenna couplers 588. The antenna coupler 588 may be configured to transmit in different frequency bands and/or using different wireless communication protocols. The antenna coupler 588 may be directional, omnidirectional, or non-directional antennas. In addition to sending data, the antenna coupler 588 may also receive data, which is sent to appropriate RF modules 584 connected to the antenna coupler 588.

In one embodiment, the user device 505 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of an antenna structure that operates at a first frequency band and the second wireless connection is associated with a second resonant mode of the antenna structure that operates at a second frequency band. In another embodiment, the first wireless connection is associated with a first antenna element and the second wireless connection is associated with a second antenna element. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though modem 522 is shown to control transmission and reception via the antenna coupler 588, the user device 505 may alternatively include multiple modems, each of which is configured to transmit/receive data via a different antenna and/or wireless transmission protocol.

The user device 505 delivers and/or receives items, upgrades, and/or other information via the network. For example, the user device 505 may download or receive items from an item providing system. The item providing system receives various requests, instructions and other data from the user device 505 via the network. The item providing system may include one or more machines (e.g., one or more server computer systems, routers, gateways, etc.) that have processing and storage capabilities to provide the above functionality. Communication between the item providing system and the user device 505 may be enabled via any communication infrastructure. One example of such an infrastructure includes a combination of a wide area network (WAN) and wireless infrastructure, which allows a user to use the user device 505 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by products based on IEEE 802.11x standards for the Wi-Fi® technology by Wi-Fi® Alliance. Another of the wireless communication systems may be a wireless carrier system that can be implemented using various data processing equipment, communication towers, etc. Alternatively, or in addition, the wireless carrier system may rely on satellite technology to exchange information with the user device 505.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 505 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 505 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:

an antenna carrier structure, comprising:

a first circuit board disposed in a first plane;

a second circuit board disposed in a second plane that is parallel to the first plane; and a third circuit board disposed in a third plane that is parallel to the first plane, wherein the second circuit board and the third circuit board are equidistant from the first circuit board;

a first dipole antenna disposed on the first circuit board at a center of the first circuit board;

a first antenna pair disposed on the first circuit board, the first antenna pair comprising a second dipole antenna and a third dipole antenna located along a first axis of the first circuit board that passes through the center of the first circuit board, wherein the first dipole antenna and the second dipole antenna are equidistant from the center of the first circuit board; and a second antenna pair disposed on the first circuit board, the second antenna pair comprising a fourth dipole antenna and a fifth dipole antenna located along a second axis of the first circuit board that passes through the center of the first circuit board, wherein the fourth dipole antenna and the second dipole antenna are equidistant from the center of the first circuit board and the second axis is orthogonal to the first axis.

2. The electronic device of claim 1, further comprising:

a first radio;

a first radio frequency (RF) feed coupled to the first dipole antenna and the first radio;

a second radio;

a second RF feed coupled to the second dipole antenna and the second radio;

a third RF feed coupled to the third dipole antenna and the second radio;

a third radio;

a fourth RF feed coupled to the fourth dipole antenna and the third radio; and a fifth RF feed coupled to the fifth dipole antenna and the third radio.

3. The electronic device of claim 2, further comprising:

a port of the first radio coupled to the first RF feed of the first dipole antenna;

a first power divider coupled to a port of the second radio, wherein a first output of the first power divider is coupled to the second RF feed of the second dipole antenna;

a first phase shifter coupled between a second output of the first power divider and the third RF feed of the third antenna;

a second power divider coupled to a port of the third radio, wherein a first output of the second power divider is coupled to the fourth RF feed of the fourth dipole antenna; and a second phase shifter coupled between a second output of the second power divider and the fifth RF feed of the fifth dipole antenna.

4. The electronic device of claim 1, further comprising a third antenna pair comprising a sixth dipole antenna disposed on the second circuit board and a seventh dipole antenna disposed on the third circuit board, wherein the sixth dipole antenna and the seventh antenna are located along a third axis that passes through the center of the first circuit board and is perpendicular to the first axis and the second axis.

5. An electronic device comprising:

a first antenna carrier;

a first antenna disposed on the first antenna carrier and coupled to a first radio frequency (RF) feed;

a second antenna disposed on the first antenna carrier and coupled to a second RF feed, wherein the first antenna and the second antenna are located along a first axis of the first antenna carrier that passes through a center of the first antenna carrier, and wherein the first antenna and the second antenna are equidistant from the center of the first antenna carrier;

a third antenna disposed on the first antenna carrier and coupled to a third RF feed; and a fourth antenna disposed on the first antenna carrier and coupled to a fourth RF feed, wherein the third antenna and the fourth antenna are located along a second axis of the first antenna carrier that passes through the center of the first antenna carrier, wherein the third antenna and the fourth antenna are equidistant from the center of the first antenna carrier, and wherein the second axis is perpendicular to the first axis and the second axis is orthogonal to the first axis.

6. The electronic device of claim 5, further comprising:

a first radio coupled to the first RF feed and the second RF feed, wherein the first antenna and the second antenna are to radiate a portion of first electromagnetic energy over a first wireless channel; and a second radio coupled to the third RF feed and the fourth RF feed, wherein the third antenna and the fourth antenna are to concurrently radiate a portion of second electromagnetic energy over a second wireless channel.

7. The electronic device of claim 6, further comprising:

a first power divider coupled to a port of the first radio, wherein a first output of the first power divider is coupled to the first RF feed of the first antenna;

a first phase shifter coupled between a second output of the first power divider and the second RF feed of the second antenna;

a second power divider coupled to a port of the second radio, wherein a first output of the second power divider is coupled to the third RF feed of the third antenna; and a second phase shifter coupled between a second output of the second power divider and a fourth RF feed of the fourth antenna.

8. The electronic device of claim 5, further comprising:

a third radio; and a fifth antenna disposed on the first antenna carrier and coupled to a fifth RF feed and to the third radio, wherein the fifth antenna is located at the center of the first antenna carrier.

9. The electronic device of claim 5, further comprising:

a second antenna carrier;

a fifth antenna disposed on the second antenna carrier;

a third antenna carrier, wherein the second antenna carrier and the third antenna carrier are parallel to, and equidistant from, the first antenna carrier;

a sixth antenna disposed on the third antenna carrier, wherein the fifth antenna and the sixth antenna are located along a third axis that passes through the center of the first antenna carrier and is perpendicular to the first axis and the second axis; and a seventh antenna disposed on the first antenna carrier at the center of the first antenna carrier.

10. The electronic device of claim 9, wherein the first antenna is a dipole antenna, wherein the second antenna is a dipole antenna, wherein the third antenna is a dipole antenna, wherein the fourth antenna is a dipole antenna, wherein the fifth antenna is a dipole antenna, wherein the sixth antenna is a slot antenna, and wherein the seventh antenna is a slot antenna.

11. The electronic device of claim 9, wherein the sixth antenna is a slot antenna and the second antenna carrier is a ground plane for the sixth antenna, and wherein the seventh antenna is a slot antenna and the third antenna carrier is a ground plane for the seventh antenna.

12. The electronic device of claim 9, wherein the first antenna carrier is disposed on a plane, wherein the first antenna is a first dipole antenna with an orientation that is parallel to the plane, wherein the second antenna is a second dipole antenna with an orientation that is parallel to the plane, wherein the third antenna is a third dipole antenna with an orientation that is parallel to the plane, wherein the fourth antenna is a fourth dipole antenna with an orientation that is parallel to the plane, wherein the fifth antenna is a fifth dipole antenna with an orientation that is parallel to the plane, wherein the sixth antenna is a sixth dipole antenna with an orientation that is perpendicular to the plane, wherein the seventh antenna is a seventh dipole antenna with an orientation that is perpendicular to the plane.

13. An apparatus comprising:

a first antenna and a second antenna disposed on a first substrate, wherein the first antenna and the second antenna are located along a first axis of the first substrate, and wherein the first antenna and the second antenna are equidistant from a center of the first substrate;

a third antenna and a fourth antenna disposed on the first substrate, wherein the third antenna and the fourth antenna are located along a second axis of the first substrate, and wherein the third antenna and the fourth antenna are equidistant from the center of the first substrate and the second axis is orthogonal to the first axis; and a fifth antenna disposed on a second substrate; and a sixth antenna disposed on a third substrate, wherein the second substrate and the third substrate are parallel to, and equidistant from, the first substrate, and wherein the fifth antenna and the sixth antenna are located along a third axis that passes through the center of the first substrate and is perpendicular to the first axis and the second axis.

14. The apparatus of claim 13, wherein the first antenna is to radiate first electromagnetic energy, wherein the second antenna is to radiate second electromagnetic energy, wherein the third antenna is to radiate third electromagnetic energy, wherein the fourth antenna is to radiate fourth electromagnetic energy, wherein the fifth antenna is to radiate fifth electromagnetic energy, wherein the sixth antenna is to radiate sixth electromagnetic energy, wherein at least a portion of the first electromagnetic energy, the second electromagnetic energy, the third electromagnetic energy, the fourth electromagnetic energy, the fifth electromagnetic energy, and the sixth electromagnetic energy are to be radiated concurrently on a first wireless channel, a second wireless channel, and a third wireless channel, respectively.

15. The apparatus of claim 13, wherein the first antenna and the second antenna are to receive first electromagnetic energy, wherein the third antenna and the fourth antenna are to receive second electromagnetic energy, wherein the fifth antenna and the sixth antenna are to receive third electromagnetic energy, and wherein at least a portion of the first electromagnetic energy, the second electromagnetic energy, and the third electromagnetic energy are to be received concurrently on a first wireless channel, a second wireless channel, and a third wireless channel, respectively.

16. The apparatus of claim 15, wherein the first antenna and the second antenna are separated along the first axis by a first distance that corresponds to approximately a half a wave length of a first frequency of the first electromagnetic energy, wherein the third antenna and the fourth antenna are separated along the second axis by a second distance that corresponds to approximately a half a wave length of a second frequency of the second electromagnetic energy, and wherein the fifth antenna and the sixth antenna are separated along the third axis by a third distance corresponding to approximately a half a wave length of a third frequency of the third electromagnetic energy.

17. The apparatus of claim 13, wherein the first antenna and the second antenna are coupled to a first port of a multi-channel single-chip radio, wherein the third antenna and the fourth antenna are coupled to a second port of the multi-channel single-chip radio, and wherein the fifth antenna is coupled to a third port of the multi-channel single-chip radio.

18. The apparatus of claim 13, further comprising:

a first support structure attached between the first substrate and the second substrate, wherein the first support structure comprises a first beam and a second beam that are equidistant from the center of the first substrate; and a second support structure attached between the first substrate and the third substrate, wherein the second support structure comprises a third beam and a fourth beam that are equidistant from the center of the second substrate.

19. The apparatus of claim 18, wherein:

the first support structure further comprises a fifth beam and a sixth beam that are equidistant from the center of the first substrate; and the second support structure further comprises a seventh beam and an eight beam that are equidistant from the center of the first substrate.

20. The apparatus of claim 18, wherein the first beam and the second beam are attached to the first support structure at locations along one of the first axis or the second axis, and wherein the third beam and the fourth beam are attached to the first support structure at locations along one of the first axis or the second axis.

* * * * *